United States Patent [19]

Allen

[11] Patent Number: 4,826,162

[45] Date of Patent: May 2, 1989

[54] COMPACT BASKETBALL GOAL AND BACKBOARD ASSEMBLY

[75] Inventor: David A. Allen, New Berlin, Wis.

[73] Assignee: Huffy Corporation, Miamisburg, Ohio

[21] Appl. No.: 915,805

[22] Filed: Oct. 6, 1986

[51] Int. Cl.[4] ..... A63B 63/08

[52] U.S. Cl. ..... 273/1.5 R; 206/315.1; 206/579

[58] Field of Search ..... 273/1.5 R, 1.5 A; D21/201; 206/579,223, 315.1, 576

[56] References Cited

U.S. PATENT DOCUMENTS

| | | | |
|---|---|---|---|
| Re. 20,898 | 12/1938 | Schabinger . | |
| 1,218,204 | 2/1917 | Ohlson . | |
| 1,504,292 | 8/1924 | Wickes . | |
| 1,667,887 | 6/1928 | Fallert . | |
| 1,669,169 | 7/1928 | Moss . | |
| 1,906,622 | 3/1933 | Kondolf . | |
| 2,363,634 | 1/1944 | Albach et al. . | |
| 2,594,628 | 4/1952 | Evans . | |
| 2,596,543 | 8/1952 | Fox . | |
| 2,666,641 | 10/1954 | Bonham . | |
| 2,791,363 | 3/1957 | Boeye . | |
| 2,865,634 | 3/1958 | Townsend . | |
| 2,916,288 | 1/1959 | Chervenka . | |
| 3,017,183 | 6/1962 | Chalcroft . | |
| 3,018,102 | 7/1962 | Murphy . | |
| 3,027,061 | 4/1962 | Locke . | |
| 3,399,889 | 2/1968 | Harry . | |
| 3,462,143 | 3/1969 | Bidelman et al. . | |
| 3,497,057 | 7/1970 | Traner et al. . | |
| 3,544,109 | 12/1970 | Woods | 273/1.5 R |
| 3,603,588 | 11/1971 | Ebstein . | |
| 3,702,700 | 11/1972 | Burke | 273/1.5 R |
| 3,716,234 | 6/1973 | Lancellotti . | |
| 3,780,933 | 7/1973 | Freeman . | |
| 3,788,642 | 8/1974 | Matras et al. . | |
| 3,820,784 | 3/1974 | Boitano et al. . | |
| 3,881,724 | 5/1975 | Beveridge . | |
| 3,896,987 | 12/1975 | Soja . | |
| 3,929,225 | 7/1975 | Locke et al. . | |
| 3,949,932 | 2/1976 | Shore . | |
| 3,964,743 | 6/1976 | Salskh, Sr. | 273/1.5 R |
| 3,967,819 | 10/1976 | Lewis . | |
| 4,009,779 | 3/1977 | Frye . | |
| 4,009,780 | 8/1977 | Frye . | |
| 4,145,044 | 6/1979 | Wilson et al. . | |
| 4,170,297 | 8/1979 | Johnson . | |
| 4,197,788 | 2/1980 | Wharton, Jr. . | |
| 4,349,105 | 9/1982 | Bradley et al. . | |
| 4,412,679 | 11/1983 | Mahoney et al. . | |
| 4,424,968 | 1/1984 | Smith | 273/1.5 R |
| 4,469,224 | 6/1984 | Ritter . | |
| 4,583,732 | 3/1986 | Allen . | |
| 4,650,188 | 3/1987 | Schroeder | 273/1.5 R |

OTHER PUBLICATIONS

Basketball Digest 5-1981, p. 7, Skaled Down Basketball.

"DP Fit for Life", 25 Years of Innovation, 1986, Diversified Products, Opelika, Alabama, p. 68.

"Lifetime Products Dealer Price List", P.O. Box 9258, Ogden, Utah 84409.

Huffy Sports, spring 1986, 2018 S. First St, Milwaukee, Wis. 53207 (414), 482-4240, pp. 1-15.

*Primary Examiner*—Paul E. Shapiro

*Attorney, Agent, or Firm*—Andrus, Sceales, Starke & Sawall

[57] ABSTRACT

A basketball goal (14) and backboard (2) assembly are provided for shipment in a carton (120) having a girth plus longest dimension less than or equal to 108 inches, for shipment by common carrier. A backboard (2) is provided with reduced outside dimension for saving material cost, particularly fiberglass, yet still affording 92% of the playing surface area of a conventional board. Support bracket hardware (30) is provided with significantly reduced shipping height requirements, yet providing precise 90° mounted orientation of the rim (20) relative to the backboard (2), by slight deformation of interlocking bosses (78, 80) in mating nested relation upon tightening of bolts (62 and 68) through mounting apertures (58, 60, 64, 66) subject to tolerance deviation which may otherwise deviate the position of the rim (20) from horizontal, particularly at the forward edge.

15 Claims, 3 Drawing Sheets

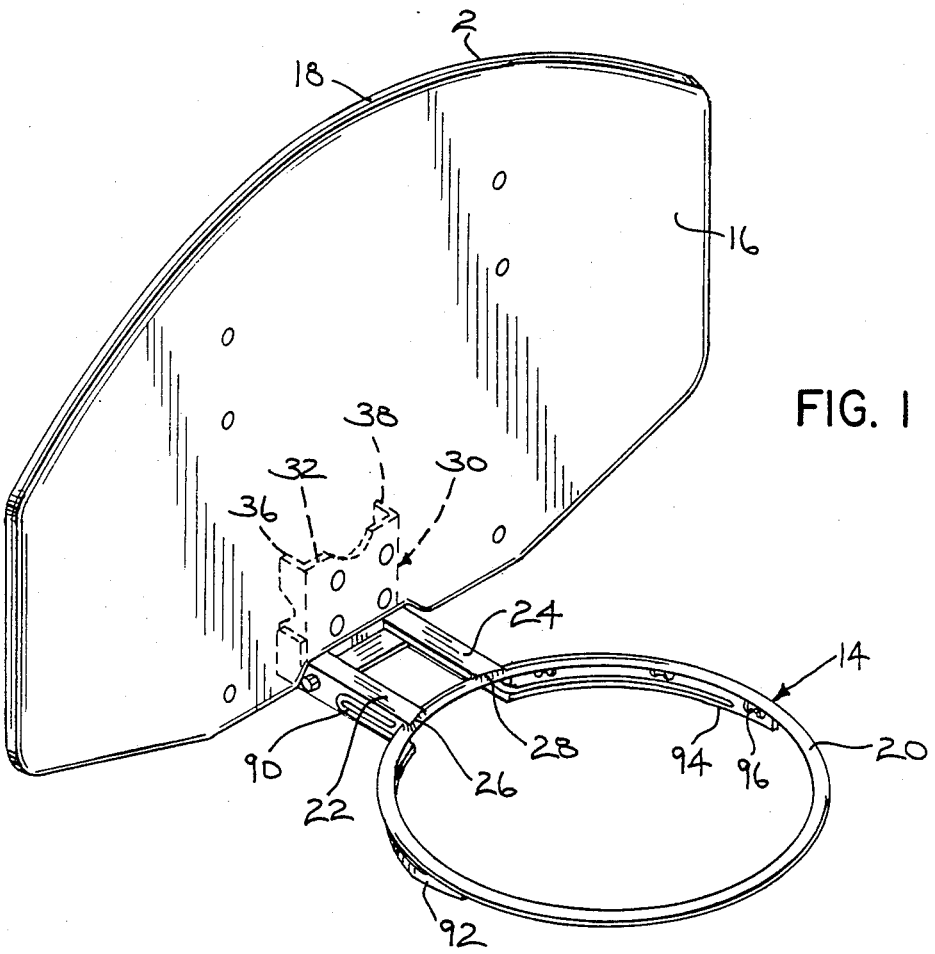
FIG. 1
FIG. 2
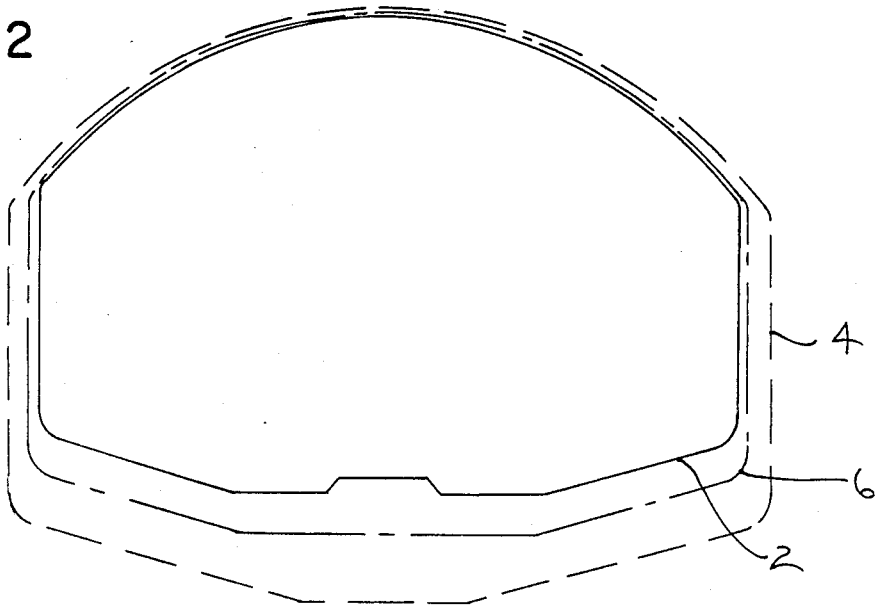

COMPACT BASKETBALL GOAL AND BACKBOARD ASSEMBLY

BACKGROUND AND SUMMARY

The invention relates to basketball goal and backboard assemblies, and particularly arose from efforts to provide a compact assembly for shipping and also to provide maximum backboard playing surface in a minimum size outer dimension, to reduce material content and hence cost.

A basketball backboard is typically about 48 inches wide by about 36 inches high and made of various materials including wood, treated wood, particle board, fiberglass, etc. Fiberglass is considered by many to be superior because of its weather resistant qualities. The cost of a fiberglass board is determined by the unit cost of the fiberglass and the size of the board. Larger boards such as 54 inch by 36 inch are thus more expensive than a 48 inch by 36 inch board. In an effort to reduce cost, some manufacturers offer smaller size fiberglass boards, such as 46 inch by 32 inch and 44 inch by 32 inch. This smaller size reduces the playing surface area.

In the preferred embodiment of the present invention, a reduced size backboard is provided having an outer dimension of 44 inch by 29 inch, but still providing 92% of the surface playing area of a 48 inch by 36 inch board. The invention includes other dimensions.

The invention also provides a basketball goal and backboard assembly which can be shipped in a compact carton meeting certain common carrier regulations, namely a girth plus longest dimension no greater than 108 inches. In the above noted preferred embodiment, the longest dimension of the carton is 44 inches to accommodate the length of the backboard. The girth, i.e. the dimension around the carton, is the 29 inch width of the backboard times two, plus a 3 inch carton depth times two, thus providing a girth of 64 inches. The longest dimension plus the girth is thus 108 inches. A specially designed user-assembled mounting plate and goal arm assembly is provided. The goal rim lays flat on the backboard in the shipping carton, and the mounting plate and goal arms each have a height less than 3 inches. To accommodate shipping carton thickness, the length or width of the backboard or the height of the mounting hardware is slightly reduced, and in the preferred embodiment the latter dimension is reduced.

Prior backboard and goal assemblies typically require a shipping carton having a girth plus longest dimension substantially more than 108 inches, and hence are not shippable by the noted common carrier. The larger shipping carton is typically necessitated by a larger backboard, and/or mounting hardware having a given minimum height which in turn increases the depth of the carton and hence the girth.

The present invention meets the 108 inch common carrier rule and also affords a significant cost reduction in backboard cost, particularly fiberglass, while still retaining the noted 92% of the playing surface area of a standard 48 inch by 36 inch board. The ability to ship by common carrier is particularly desirable for further cost reduction in inventory control, storage space, and the elimination of special handling techniques and freight arrangements.

The invention provides mounting bracket structure assembled by the user and yet still providing a precise 90° relation between the rim and the backboard, notwithstanding tolerance deviations between the noted mounting plate and goal arms. Mating apertures are provided between the mounting plate and goal arms in the preferred embodiment for fastening by means of bolts therethrough. Fastener deviation in the diameter of the apertures and the bolts, even if slight, will cause a deviation in rim position from horizontal, particularly at the outer tip thereof. An interlocking mating nesting boss arrangement is provided where there is deformation of bosses upon tightened engagement by the bolts to enable flush nested engagement and precise 90° mounting.

BRIEF DESCRIPTION OF THE DRAWINGS

FIG. 1 shows an assembled perspective view of a basketball goal and backboard assembly in accordance with the invention.

FIG. 2 shows a front view of the backboard of FIG. 1 overlaid on prior backboards in dashed line.

DETAILED DESCRIPTION

FIG. 1 shows a basketball backboard and goal assembly in accordance with the invention. FIG. 2 shows a front view in solid line of the backboard 2 of FIG. 1. Backboard 2 is also shown in FIG. 7 in the middle. In the preferred embodiment, backboard 2 is a fiberglass member having a left-right width of about 44 inches and an up-down height of about 29 inches, though the invention is not limited thereto. FIG. 2 also shows in dashed line a conventional backboard 4 having a left-right width of 48 inches and an up-down height of 36 inches. Backboard 4 is also shown on the left in FIG. 6. FIG. 2 also shows a backboard 6 known in the prior art and is an embodiment providing a reduced size lower cost alternative to backboard 4. Backboard 6 is shown on the right in FIG. 6.

Figure 6:
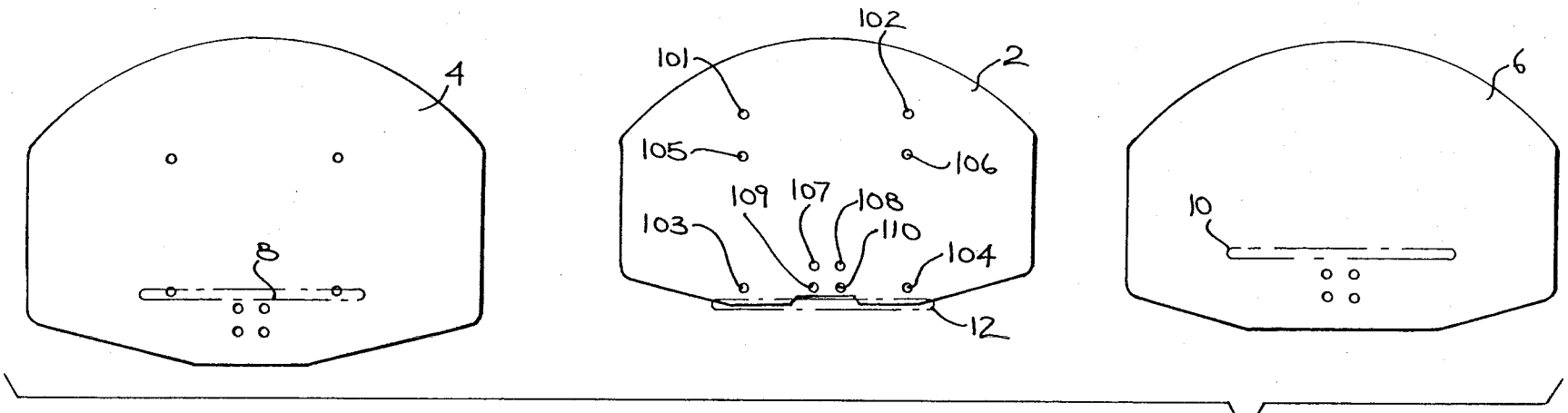
FIG. 6 shows a front view of the backboard of FIG. 1 flanked by a pair of prior art boards.
Figure 7:
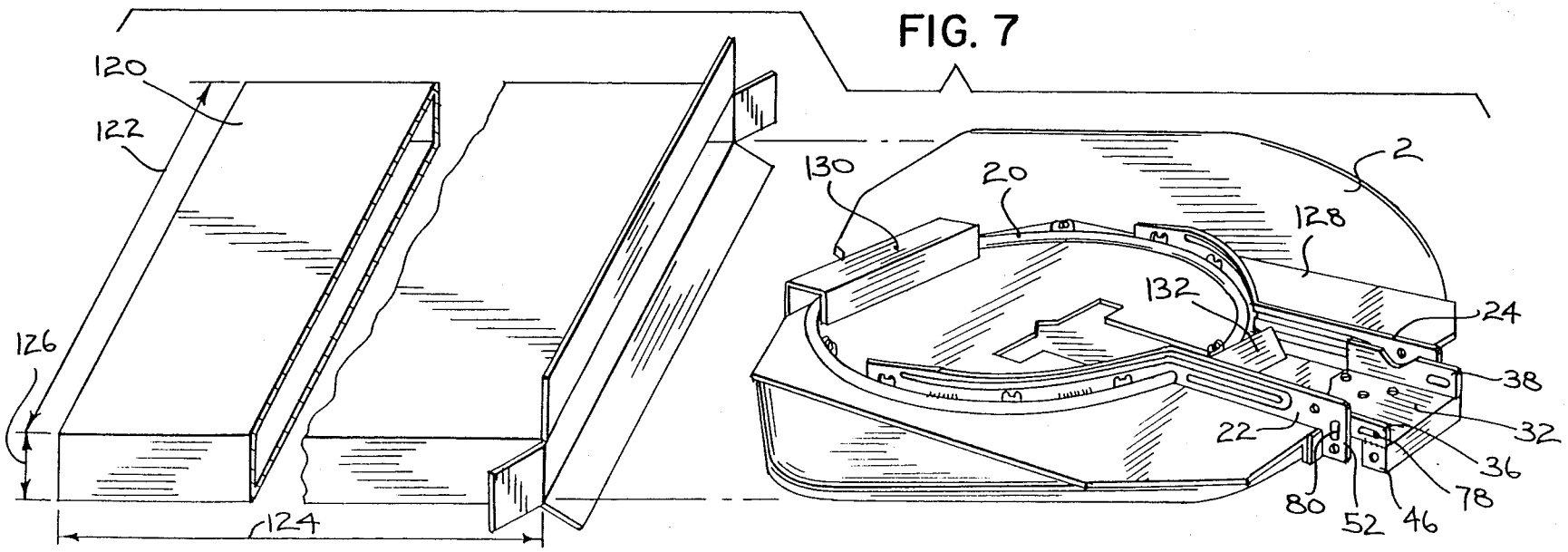
FIG. 7 shows a perspective preassembly view of the structure of FIG. 1 together with a shipping carton.

Backboards 4 and 6, FIG. 6, have a lower set of four mounting holes for mounting a circular rim and its L-shaped support arm to the front of the backboard. The support arm extends horizontally rearwardly from the rear of the rim and then is bent downwardly at a 90° angle over the front of the backboard and mounted thereto. In FIG. 6, the position of the rim for backboard 4 is shown at dashed line 8, and for backboard 6 at dashed line 10. The playing surface of the board is generally above the rim.

In FIG. 6, the position of the rim for backboard 2 is shown at dashed line 12. Backboard surface below the rim has been minimized. Backboard 2 with rim position 12 has 92% of the playing surface of backboard 4 with rim position 8. Backboard 2 thus provides an outer size reduction as compared to backboard 4, but does not suffer a substantial reduction of playing surface. Backboard 6 with rim position 10 has a substantially reduced playing surface compared to backboard 4 with rim position 8. In the case of fiberglass material, backboard 2 offers a significant cost reduction over a fiberglass board of the size of backboard 4.

Figure 3:
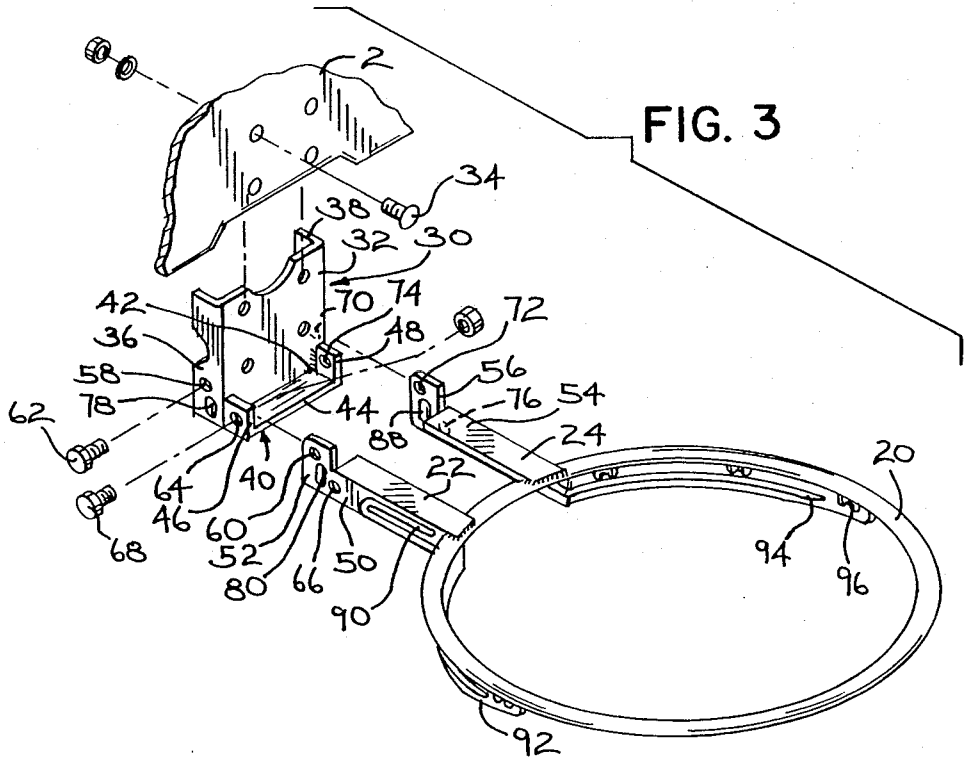
FIG. 3 shows an exploded perspective view of a portion of FIG. 1.
Figure 4:
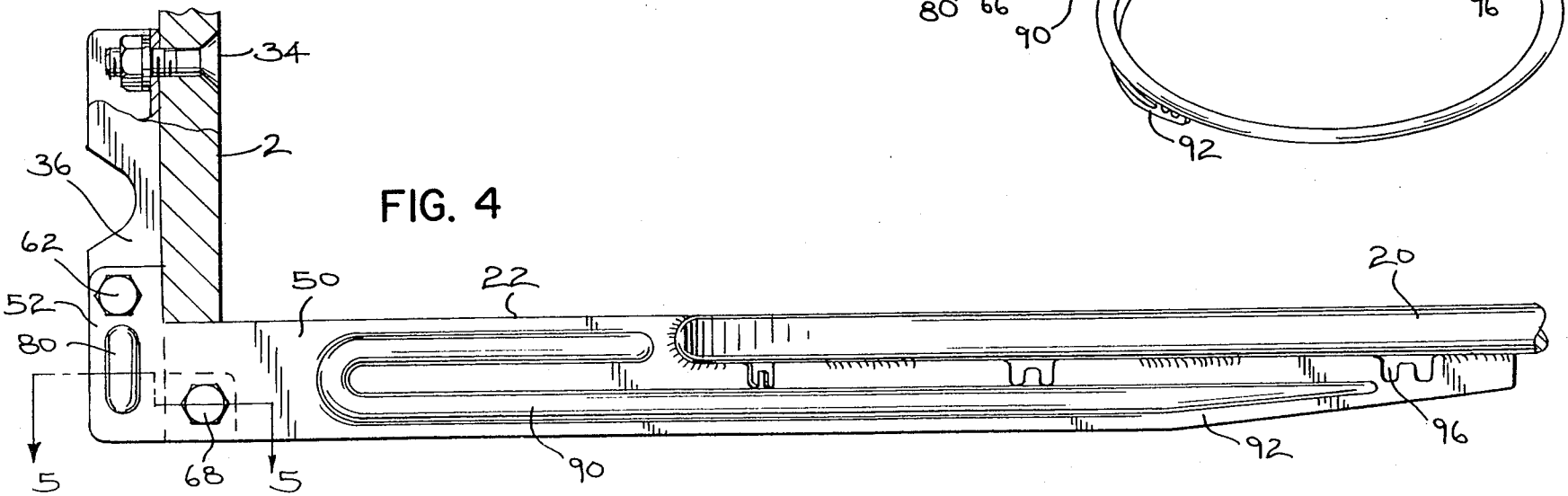
FIG. 4 shows a side view of a portion of FIG. 1.

Referring to FIGS. 1, 3 and 4, there is shown a goal 14 for backboard 2. Backboard 2 has a front vertical playing surface 16 and a rear vertical surface 18. Goal 14 includes a circular rim 20 having a horizontal playing position. A pair of goal arms 22 and 24 are rigidly connected to the rear of the rim at weldments 26 and 28 and have a playing position extending horizontally beneath backboard 2. A support bracket 30 is provided for mounting goal arms 22 and 24 to the backboard and includes a central plate 32 mounted against the rear surface 18 of the backboard by bolts such as 34 extending through mating apertures in the backboard and plate. The left and right sides of plate 32 are bent rearwardly at a 90° angle to form left and right flanges 36 and 38 extending rearwardly from the central part of plate 32. A U-shaped member 40 is rigidly connected to the front of plate 32 at weldments 42 and has a central horizontally extending bight portion 44 facing upwardly, and left and right upwardly extending legs 46 and 48 which provide left and right side flanges extending forwardly from plate 32.

Left goal arm 22 is an L-shaped member having a horizontal leg 50 extending horizontally rearwardly beneath the backboard and contiguously along and engaging the outside of left forward flange 46, and having a vertical leg 52 extending vertically upwardly behind the backboard and contiguously along and engaging the outside of left rearward flange 36. Right goal arm 24 is an L-shaped member having a horizontal leg 54 extending horizontally rearwardly beneath the backboard and contiguously along and engaging the outside of right forward flange 48, and having a vertical leg 56 extending vertically upwardly behind the backboard contiguously along and engaging the outside of right rear flange 38.

Left rear flange 36 has an aperture 58 therethrough mating with an aperture 60 through the vertical leg 52 of left goal arm 22 and receiving a mounting bolt 62 therethrough. Left forward flange 46 has an aperture 64 therethrough mating with an aperture 66 through the horizontal leg 50 of left goal arm 22 and receiving a mounting bolt 68 therethrough. Right rear flange 38 has an aperture 70 therethrough mating with an aperture 72 through the vertical leg 56 of right goal arm 24 for receiving a mounting bolt therethrough. Right forward flange 48 has an aperture 74 therethrough mating with an aperture 76 through the horizontal leg 54 of right goal arm 24 for receiving a mounting bolt therethrough.

Figure 5:
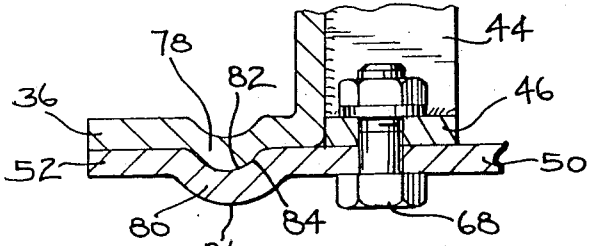
FIG. 5 is a sectional view taken along line 5—5 of FIG. 4.

Deviations in the tolerances of mounting apertures 58, 60, 64, 66, 70, 72, 74 and 76, and the mounting bolts, even slight, may cause deviation of rim 20 from the desired horizontal playing position, particularly at the forward outer tip of the rim. Interlocking detent bosses are provided to positively and precisely locate rim 20 at a 90° playing position relative to backboard 2, regardless of such tolerance deviations. Left rearward flange 36 has a detent boss 78 formed therein, and the vertical leg 52 of left goal arm 22 has a detent boss 80 formed therein. Referring to FIG. 5, the outer diameter 82 of boss 78 is larger than the inner diameter 84 of boss 80, and there is slight deformation of the bosses upon tightened engagement by the bolts such as 68, to enable flush nested engagement of boss 78 with boss 80 and provide the precise 90° relation between the rim and backboard, notwithstanding the noted tolerance deviations of the apertures and mounting bolts.

In the preferred embodiment, each boss is formed by the same size punch during manufacture of the individual component. Thus, the outer diameter 82 of boss 78 is the same as the outer diameter 86 of boss 80. When the goal arms are assembled to the mounting plate, boss 78 is received and nested in boss 80, FIG. 5. Receiving boss 80 has inner diameter 84 smaller than the outer diameter 82 of boss 78 by an amount determined by the material thickness. Aperature 58, detent boss 78 and aperture 64 define an L-shape. Right rear flange 38 likewise has a detent boss (not shown) mating with detent boss 88 in vertical leg 56 of right goal arm 24, comparably to detent bosses 78 and 80.

Goal arms 22 and 24 are ribbed as at 90 for added strength and include portions 92 and 94 extending forwardly and partially around the perimeter beneath rim 20 for further support, which support portions may include net eyelets such as 96.

Referring to FIG. 6, backboard 2 has upper left and upper right apertures 101 and 102 therethrough spaced horizontally left-right and defining a first horizontal row. Lower left and lower right apertures 103 and 104 are formed through the backboard and are horizontally spaced left-right and define a horizontal row spaced below row 101–102 defined by apertures 101 and 102. Apertures 105 and 106 are formed through the backboard and are spaced horizontally left-right and define a horizontal row below row 101–102. Row 105–106 is spaced above row 103–104 by a distance greater than the spacing of row 105–106 below row 101–102. Apertures 107 and 108 are formed through the backboard and are spaced horizontally left-right and define a horizontal row below row 105–106. Row 107–108 is spaced above row 103–104 by a distance less than the spacing of row 107–108 below row 105–106. The horizontal length of row 107–108 as defined by apertures 107 and 108 is less than the horizontal length of each of rows 101–102, 103–104 and 105–106. Apertures 109 and 110 are formed through the backboard and are spaced horizontally left-right and define a row below row 107–108. The horizontal length of row 109–110 as defined by apertures 109 and 110 is less than the horizontal length of each of rows 101–102, 103–104 and 105–106. Each of the apertures 101–110 are counter-sunk from the front playing surface 16 of the board.

Apertures 101–104 provided means for mounting backboard 2 to wall or roof mounted support structure. Apertures 105–110 provide means for mounting the backboard to pole mounted support structure, e.g. with an extension arm between the pole and the backboard and with mounting plate 32 sandwiched between the extension arm and backboard 2. Apertures 107–110 provide means for mounting rim 20 via bracket 30 to the rear surface 18 of backboard 2. Row 109–110 is above or colinear with row 103–104. Apertures 101–104 define a first rectangle, and apertures 107–110 define a second rectangle within rectangle 101–104. This enables the noted desirable reduction in overall backboard size, yet without significantly reducing playing surface area.

FIG. 7 shows a basketball goal, backboard and shipping carton assembly. Goal 14 and backboard 2 are contained within carton 120. The longest dimension 122 of the carton is 44 inches. The girth of the carton is dimension 124 times two, plus dimension 126 times two. Dimension 124 is 29 inches, and dimension 126 is less than 3 inches. The girth is thus 64 inches or less. The girth plus the longest dimension is thus less than or equal to 108 inches. Backboard 2 has a height substantially equal to dimension 124, and a width substantially equal to dimension 122. Vertical legs 52 and 56 of goal arms 22 and 24 have height substantially equal to dimension 126, and preferably slightly less than about 3 inches to accommodate carton material thickness, and to accommodate slightly increased dimensions 122 and 124 of the carton to accommodate carton material thickness beyond the edges of the backboard, and still retain the overall criteria of girth plus longest dimension less than or equal to 108 inches. Rearward flange 36 and forward flange 46 have a combined extension less than or equal to dimension 126. Rim 20 has a shipping position lying generally flat against backboard 2 with a piece of cardboard 128 therebetween having a flap 130 folded around the front of the rim and another flap 132 folded against the rear of the rim to position same for shipment.

It is recognized that various equivalents, alternatives and modifications are possible within the scope of the appended claims.

I claim:

1. A basketball goal for a backboard having a front vertical playing surface and a rear vertical surface, comprising:

a circular rim having a horizontal playing position;

goal arm means rigidly connected to said rim and having a playing position extending horizontally beneath said backboard;

bracket means for mounting said goal arm means to said backboard, said bracket means comprising a central plate mounted against said rear surface of said backboard, a pair of side flanges extending rearwardly from said plate, another pair of side flanges extending forwardly from said plate and beneath said backboard, and means for mounting said goal arm means to said rearward and forward flanges.

2. The invention according to claim 1 wherein said rearward flanges have detent boss means formed therein and wherein said goal arm means has detent boss means formed therein mating and interlocking with said detent boss means of said rearward flanges to positively and precisely locate said rim at a 90° playing position relative to said backboard.

3. The invention according to claim 2 wherein said goal arm means comprises first and second parallel arms each extending contiguously along and engaging a respective one of said forward and then rearward flanges, each said goal arm and a respective one of said forward flanges having mating apertures therethrough for receiving mounting bolts, and wherein each said goal arm and a respective one of said rearward flanges have mating nesting bosses formed therein, with one boss having a larger outer diameter than the inner diameter of the boss in which it nests, such that upon tightened engagement by said bolt means there is slight deformation of said bosses to enable flush nested engagement of said boss with said larger outer diameter in said boss of said smaller inner diameter and provide said precise 90° relation between said rim and said backboard notwithstanding tolerance deviations of said apertures in said forward flanges and said goal arms and said bolt means therethrough.

4. A basketball goal for a backboard having a front vertical playing surface and a rear vertical surface, comprising:

a circular rim having a horizontal playing position;

left and right spaced L-shaped goal arms rigidly connected to said rim, each goal arm having a horizontal leg extending horizontally rearwardly beneath said backboard in said playing position and having a vertical leg extending vertically upwardly behind said backboard in said playing position;

bracket means for mounting said goal arms to said backboard, said bracket means comprising a central plate mounted against said rear surface of said backboard and having left and right spaced side flanges extending rearwardly therefrom, said bracket means further comprising another pair of left and right spaced side flanges extending forwardly from said plate and beneath said backboard, said left and right goal arms extending rearwardly along the outside of respective said left and right forward flanges and then upwardly along the outside of respective said left and right rearward flanges, said left front flange having an aperture therethrough mating with an aperture through said horizontal leg of said left goal arm, said right front flange having an aperture therethrough mating with an aperture through said horizontal leg of said right goal arm, said left rear flange having an aperture therethrough mating with an aperture through said vertical leg of said left goal arm, said right rear flange having an aperture therethrough mating with an aperture through said vertical leg of said right goal arm, and bolt means extending through said apertures for fastening said goal arms to said flanges.

5. The invention according to claim 4 wherein each of said rearward flanges has a detent boss formed therein below the respective said aperture therein, said aperture of said left rearward flange and said boss of said left rearward flange and said aperture of said left forward flange defining an L-shape, said aperture of said right rearward flange and said boss of said right rearward flange and said aperture of said right forward flange defining an L-shape, each of said left and right goal arms having a detent boss formed therein interlocking and mating in nested relation with a respective detent boss of said left and right rearward flanges.

6. The invention according to claim 5 wherein said boss of said left goal arm has the same outer diameter as said boss of said left rearward flange such that when said last mentioned bosses are in nested relation and one boss is received in the other boss, the receiving boss has an inner diameter smaller than the outer diameter of said one boss by an amount determined by the thickness of the material of the receiving boss, and such that upon tightened engagement there is slight deformation of said bosses to enable flush nested engagement, and such that said other two remaining bosses are likewise nested.

7. The invention according to claim 6 comprising a U-shaped member rigidly connected to the front bottom of said central plate of said bracket means such that the central bight of the U extends generally horizontally in said playing position and the legs of the U providing said left and right forward flanges.

8. A basketball goal, backboard and shipping carton assembly, said basketball goal and backboard being contained within said carton, said carton having a girth plus longest dimension less than or equal to 108 inches, comprising in combination:

a backboard having a front vertical playing surface and a rear vertical surface, and having a width of about 44 inches and a height of about 29 inches;

a goal comprising a circular rim having a horizontal playing position;

goal arm means rigidly connected to said rim and extending horizontally rearwardly beneath said backboard in said playing position, said rim having a shipping position lying generally flat against said backboard;

bracket means for mounting said goal arm means to said backboard in said playing position, said bracket means comprising a central plate mounted against said rear surface of said backboard in said playing position and comprising fastening means for fastening said goal arm means to said central plate.

9. The invention according to claim 8 wherein said goal arm means is L-shaped and has a horizontal leg rigidly connected to said rim and extending horizontally rearwardy beneath said backboard in said playing position and has a vertical leg extending vertically upwardly behind said backboard in said playing position, said vertical leg having a height less than about three inches, and wherein said central plate has a pair of side flanges extending rearwardly from said plate in said playing position, said bracket means further comprising another pair of side flanges extending forwardly from said plate beneath said backboard in said playing position, said fastening means fastening said goal arm means to said rearward and forward flanges, said rearward and forward flanges having a combined extension less than about three inches.

10. The invention according to claim 9 wherein each of said rearward flanges has an aperture therethrough mating with an aperture through a respective one of said vertical legs of said goal arm means, and each of said forward flanges has an aperture therethrough mating with an aperture through a respective one of said horizontal legs of said goal arm means, and comprising bolt means extending through said apertures for fastening said goal arm means to said flanges.

11. The invention according to claim 10 wherein each of said rearward flanges has a detent boss formed therein below he respective said aperture therein, said aperture in each said rearward flange and said boss of the respective said rearward flange and said aperture of the respective said forward flange defining an L-shape, and wherein said goal arm means comprises a pair of parallel L-shaped goal arms each having a detent boss formed therein for interlocking and mating in nested relation with a respective one of said detent bosses of a respective said rearward flange such that upon tightened engagement by said bolt means there is slight deformation of said bosses to enable flush nested enagement and provide a precise 90° relation between said rim and said backboard notwithstanding tolerance deviations of said apertures in said flanges and said goal arm means.

12. A basketball backboard comprising a member having a front playing surface and a rear surface, and having a vertical position with a top and a bottom, and having left and right sides, first and second upper left and upper right, respectively, apertures through said backboard and spaced horizontally left-right and defining a first horizontal row, third and fourth lower left and lower right, respectively, apertures through said backboard and spaced horizontally left-right and defining a second horizontal row below said first row, fifth and sixth apertures through said backboard and spaced horizontally left-right and defining a third horizontal row below said first row, said third row being spaced above said second row by a distance substantially less than the spacing of said first row above said second row, the horizontal length of said third row as defined by said fifth and sixth apertures being less than the horizontal length of each of said first and second rows as defined by said first and second, and said third and fourth apertures, respectively, seventh and eighth apertures through said backboard and spaced horizontally left-right and defining a fourth horizontal row below said third row and above or colinear with said second row, the horizontal length of said fourth row as defined by said seventh and eighth apertures being less than the horizontal length of each of said first and second rows as defined by said first and second, and said third and fourth apertures, respectively, wherein said first through fourth apertures define a first rectangle, and said fifth through eighth apertures define a second rectangle, said second rectangle being within said first rectangle.

13. A basketball backboard comprising a member having a front playing surface and a rear surface, and having a vertical position with a top and a bottom, and left and right sides, first and second, upper left and upper right, respectively, apertures through said backboard and spaced horizontally left-right and defining a first horizontal row, third and fourth, lower left and lower right, respectively, apertures through said backboard and spaced horizontally left-right and defining a second horizontal row below said first row, fifth and sixth apertures through said backboard and spaced horizontally left-right and defining a third horizontal row below said first row, said third row being spaced above said second row by a distance greater than the spacing of said third row below said first row, seventh and eighth apertures through said backboard and spaced horizontally left-right and defining a fourth horizontal row below said third row, said fourth row being spaced above said second row by a distance less than the spacing of said fourth row below said third row, the horizontal length of said fourth row as defined by said seventh and eighth apertures being less than the horizontal length of each of said first, second and third rows as defined by said first and second, said third and fourth, and said fifth and sixth apertures, respectively, ninth and tenth apertures through said backboard and spaced horizontally left-right and defining a fifth horizontal row below said fourth row, the horizontal length of said fifth row as defined by said ninth and tenth apertures being less than the horizontal length of each of said first, second and third rows as defined by said first and second, said third and fourth, and said fifth and sixth apertures, respectively.

14. The invention according to claim 13 wherein each of said ten apertures is counter-sunk from said front playing surface, said first through fourth apertures provide means for mounting said backboard to wall or roof mounted support structure, said fifth through tenth apertures provide means for mounting said backboard to pole mounted support structure, said seventh through tenth apertures provide means for mounting a rim to said rear surface of said backboard.

15. A basketball goal, backboard and shipping carton assembly, said basketball goal and backboard being contained within said carton, comprising in combination:

a backboard of given width and height and having a front vertical playing surface and a rear vertical surface;

a carton having a height accommodating the height of said backboard, and having a width accommodating the width of said backboard, and having a depth less than three inches, said width of said carton being the longest dimension of said carton, and wherein said carton width plus twice said carton height plus twice said carton depth is less than or equal to 108 inches, such that said carton has a girth plus longest dimension less than or equal to 108 inches:

a goal comprising a circular rim having a horizontal playing position;

goal arm means rigidly connected to said rim and extending horizontally rearwardly beneath said backboard in said playing position, said rim having a shipping position lying generally flat against said backboard;

bracket means for mounting said goal arm means to said backboard in said playing position, said bracket means comprising a central plate mounted against said rear surface of said backboard in said playing position and having flange means extending transversely to said backboard, said transverse extension of said flange means being loss than three inches;

fastening means for fastening said goal arm means to said flange means of said central plate, wherein said flange means also extends transversely to said backboard in said shipping position, and wherein said central plate lays generally flat against said backboard in said shipping position and has a portion protruding beyond the edge of said backboard within said outer carton, and wherein said flange means in said shipping position is at said protruding portion of said central plate and is beyond said edge of said backboard.

* * * * *

UNITED STATES PATENT AND TRADEMARK OFFICE

CERTIFICATE OF CORRECTION

PATENT NO. : 4,826,162

DATED : May 2, 1989

INVENTOR(S) : David A. Allen

It is certified that error appears in the above-identified patent and that said Letters Patent is hereby corrected as shown below:

Claim 7, col. 6, line 55, after "U" insert --extend upwardly, said U-shaped member being below said backboard, said upwardly extending legs of the U--after "U".

Claim 15, col. 10, line 9, delete "loss" and substitute therefore --less--.

Signed and Sealed this

First Day of January, 1991

*Attest:*

HARRY F. MANBECK, JR.

*Attesting Officer*

*Commissioner of Patents and Trademarks*